US012779354B2

(12) United States Patent
Chen

(10) Patent No.: US 12,779,354 B2
(45) Date of Patent: Nov. 3, 2026

(54) TRAIN SET STRUCTURE

(71) Applicant: Ming-Ken Chen, Taipei (TW)

(72) Inventor: Ming-Ken Chen, Taipei (TW)

( * ) Notice: Subject to any disclaimer, the term of this patent is extended or adjusted under 35 U.S.C. 154(b) by 253 days.

(21) Appl. No.: 18/658,946

(22) Filed: May 8, 2024

(65) Prior Publication Data

US 2025/0345716 A1 Nov. 13, 2025

(51) Int. Cl.

| | |
|---|---|
| ***A63H 19/14*** | (2006.01) |
| ***A63H 19/02*** | (2006.01) |
| ***A63H 19/10*** | (2006.01) |
| ***A63H 19/15*** | (2006.01) |
| ***A63H 19/18*** | (2006.01) |
| ***A63H 19/20*** | (2006.01) |
| ***A63H 19/24*** | (2006.01) |

(52) U.S. Cl.

CPC ..... *A63H 19/14* (2013.01); *A63H 19/02* (2013.01); *A63H 19/10* (2013.01); *A63H 19/15* (2013.01); *A63H 19/18* (2013.01); *A63H 19/20* (2013.01); *A63H 19/24* (2013.01)

(58) Field of Classification Search

CPC ..... A63H 19/02; A63H 19/10; A63H 19/14; A63H 19/15; A63H 19/18; A63H 19/20; A63H 19/24

See application file for complete search history.

(56) References Cited

U.S. PATENT DOCUMENTS

| | | | | |
|---|---|---|---|---|
| 2,540,216 A * | 2/1951 | Quinby | ..... | A63H 19/15 246/166 |
| 2,585,754 A * | 2/1952 | Dunkelberger | ..... | A63H 19/30 446/447 |
| D846,658 S * | 4/2019 | Gerstner | ..... | D21/541 |
| 2005/0255721 A1* | 11/2005 | Alvarez | ..... | A63H 19/18 439/65 |

(Continued)

OTHER PUBLICATIONS

"LED Interior Lighting Kit, ver.2 (Indirect Lighting Type) (DCC Optional: FR11) (6ea) (Model Train)," archived Apr. 15, 2018, available on the internet via URL https://www.1999.co.jp/eng/10205649 (Year: 2018).*

(Continued)

*Primary Examiner* — Audrey B. Walter
(74) *Attorney, Agent, or Firm* — Leong C. Lei

(57) ABSTRACT

Provided is a train set structure including a locomotive and a plurality of cars and track segments. The track segments can be connected and separated. The locomotive includes a driving unit, sprayer, liquid input hole, switch, and luminous body. The driving unit has driving rollers abutting against the track segments to drive the locomotive. The sprayer contains a liquid, with a vibrator disposed at the bottom of the sprayer, adapted to vibrate the liquid to produce aerosols, and electrically connected to a control circuit and a battery module for supply power to the vibrator. The switch is electrically connected to a music generator. The cars are connected and separated by connection hooks engaged with (Continued)

and disengaged from connection hole components respectively. The locomotive and cars move on the track segments automatically, accompanied by aerosols emitted from the sprayer, musical sounds, and flashes to achieve liveliness and entertainment.

4 Claims, 5 Drawing Sheets

(56) References Cited

U.S. PATENT DOCUMENTS

| | | | | |
|---|---|---|---|---|
| 2015/0102178 | A1* | 4/2015 | Kovach | A63H 19/10<br>246/219 |
| 2018/0085677 | A1* | 3/2018 | Atsuzawa | A63H 19/14 |

OTHER PUBLICATIONS deAO Toys, "13 Piece Classic Toy Train Set for Kids with Headlight Smoke Realistic Sounds 3 Car Carriage 11 Feet Track," archived Oct. 30, 2022, available on the internet via URL https://deaotoys.com/products/deao-13-piece-classic-toy-train-set-for-kids-with-headlight (Year: 2022).*

"Unleash The Ultimate Steam Train Experience With Realistic Smoke Effects," uploaded to YouTube on Jan. 25, 2024, availbe on the internet via URL https://www.youtube.com/watch?v=XQet6-5qCXU (Year: 2024).*

* cited by examiner

TRAIN SET STRUCTURE

TECHNICAL FIELD OF THE INVENTION

The present disclosure relates to train set structures, and more particularly to a train set structure comprising a locomotive, cars and track segments, allowing the locomotive and cars to automatically move on the track segments, allowing the locomotive to emit aerosols, produce musical sounds and generate bright light while moving, enhancing the liveliness and entertainment effects of the train set, and enhancing the ease of storage, packaging and transport of the track segments and cars.

BACKGROUND

Conventional toy trains each consist of a plurality of cars connected in series and move on track segments when driven by a simple driving structure to exhibit entertainment. However, conventional toy trains can rarely maintain customer loyalty, because their functions are restricted to automatic movement on the track segments, lacking additional entertainment functions.

In view of this, the inventor of the disclosure performed intensive research to render the disclosure radical and innovative with a view to improving the prior art, providing a good solution, and promoting industrial development.

SUMMARY OF THE INVENTION

In view of the aforesaid drawbacks of the prior art, it is an objective of the disclosure to provide a train set structure comprising a locomotive, cars and track segments, allowing the locomotive and cars to automatically move on the track segments, allowing the locomotive to emit aerosols, produce musical sounds and generate bright light while moving, enhancing the liveliness and entertainment effects of the train set, and enhancing the ease of storage, packaging and transport of the track segments and cars.

In view of the aforesaid drawbacks of the prior art, it is an objective of the disclosure to provide a train set structure, comprising a plurality of track segments, a locomotive and a plurality of cars. A through hole and two engaging slots are disposed at an end of each of the track segments, and an engaging element and two engaging bars are disposed at another end of each of the track segments, allowing the engaging element of each of the track segments to engage with the through hole of an adjacent track segment, the engaging bars of each of the track segments to engage with the engaging slots of an adjacent track segment, so as for the track segments to be connected and separated. The locomotive comprises a driving unit, a sprayer, a liquid input hole, a switch, and a luminous body. The driving unit has driving rollers abutting against the track segments to drive the locomotive. The sprayer contains a liquid, with a vibrator disposed at the bottom of the sprayer, adapted to vibrate the liquid to produce aerosols, and electrically connected to a control circuit and a battery module. The battery module supplies power to the vibrator. The liquid input hole has a liquid delivery duct in communication with the sprayer and thus enables the sprayer to be replenished. The switch is electrically connected to a music generator and adapted to start or stop music. The luminous body is disposed on the front of the locomotive. The cars each have a plurality of wheels disposed on the track segments, with a connection hole component disposed at an end of each of the cars, a connection hook disposed at another end of each of the cars.

The connection hook of each of the cars is removably engaged with the connection hole component of an adjacent one of the cars to connect and separate the cars, and the connection hook of one of the cars is engaged with a hole element disposed at a rear end of the locomotive.

According to the disclosure, a battery module directly supplies electric power to the vibrator through a control circuit, and thus the vibrator need not be connected to any external power source, such as an AC power supply. Therefore, the vibrator of the disclosure can be driven in any environment that lacks outlets and is small, compact, and easy to move.

The locomotive and the cars move on the track segments automatically, accompanied by aerosols emitted from the sprayer to simulate smoke leaving a chimney of a train, musical sounds, and forwarding flashes, enhancing the liveliness and entertainment of the train set. The track segments and the cars are easy to store, package and transport and have a decorative effect.

In an embodiment, the track segments are selectively made of a resilient material, such as plastic, to have resilient deformation allowance to not only allow the engaging element to be engaged with and coupled to the through hole but also allow the engaging bars to be engaged with and coupled to the engaging slots.

In an embodiment, the sprayer opens upward and wide, allowing the aerosols produced to be emitted upward.

In an embodiment, the locomotive and the cars have decorative components respectively.

In an embodiment, the sprayer is connected to a cover, and the cover removably conceals the liquid input hole.

In an embodiment, the connection hook is pivotally repositionable.

In an embodiment, the cars are made of a transparent material and each have therein a light-emitting unit, whereas the connection hole component, the connection hook and the hole element are made of a metallic, electrically-conductive material and thus can be electrically in contact with each other, with the connection hook electrically connected to the light-emitting unit, and the hole element electrically connected to a power supply unit of the locomotive.

In an embodiment, a transmission unit is disposed between the decorative component and the wheels and adapted to convert rotation of the wheels into rotation of the decorative component.

In terms of the aforesaid advantages, preferred embodiments are hereunder presented to allow persons skilled in the art to gain insight into the disclosure. The contents and achievable benefits of the disclosure are described below in accordance with drawings and reference numerals.

DETAILED DESCRIPTION OF THE PREFERRED EMBODIMENTS

The implementation of the disclosure is hereunder illustrated by specific embodiments. Persons skilled in the art can easily understand other advantages and effects of the disclosure by referring to the disclosure contained in the specification. The disclosure can be implemented or applied in accordance with other different specific embodiments and is subject to various modifications and changes without departing from the spirit of the disclosure.

Figure 1:
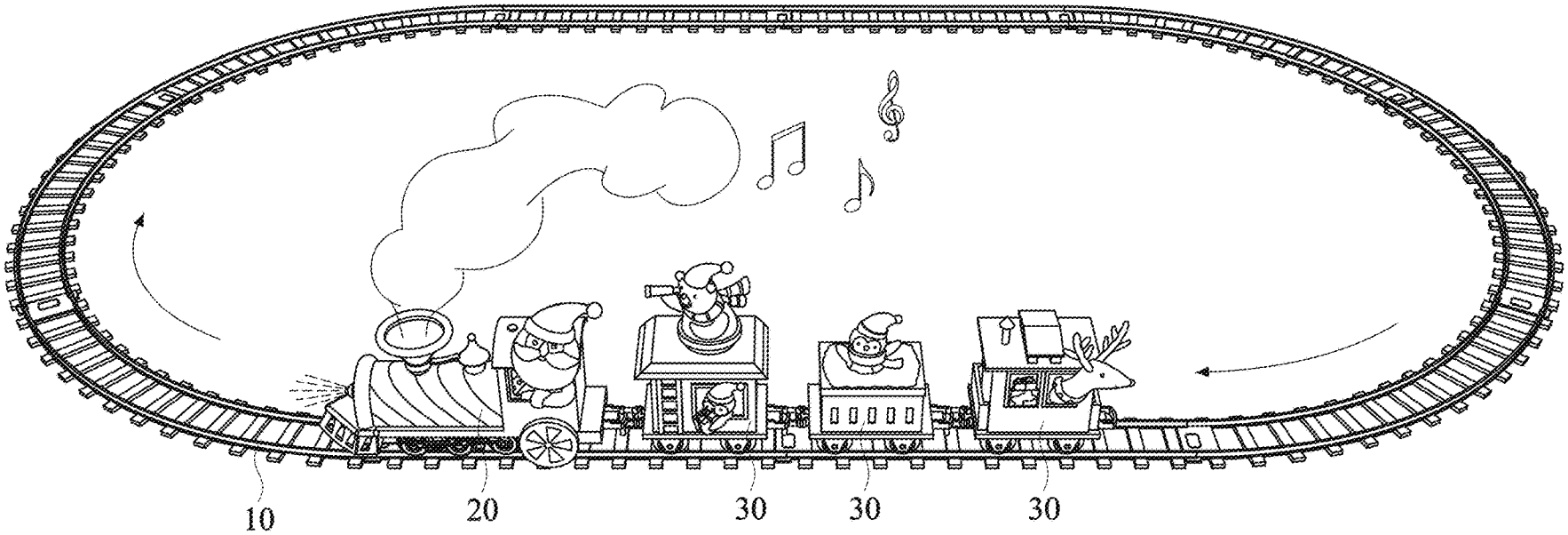
FIG. 1 is a perspective view of a train set structure of the disclosure.
Figure 2:
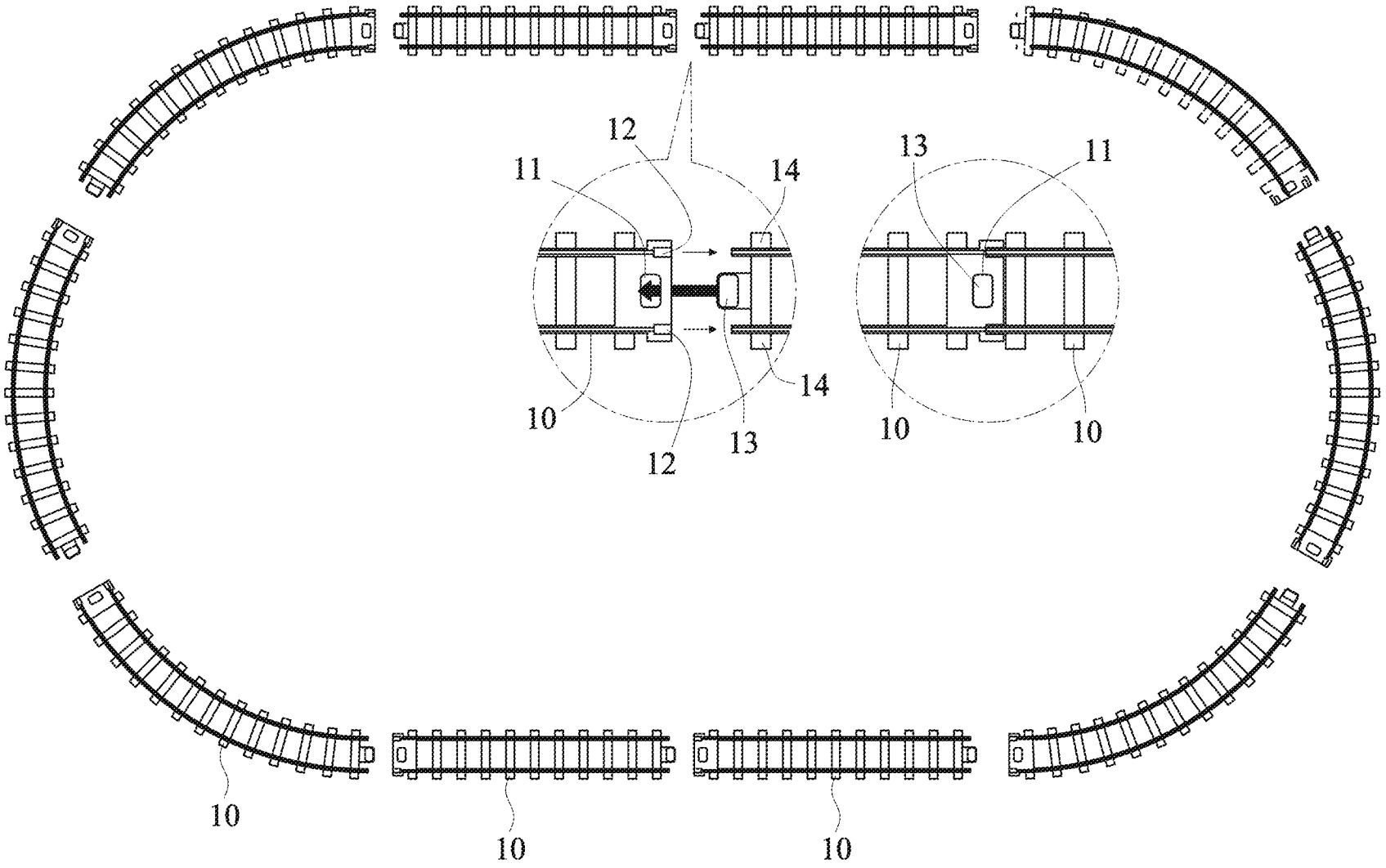
FIG. 2 is a schematic view of track segments of the train set structure according to the disclosure, showing how to connect and separate the track segments.
Figure 3:
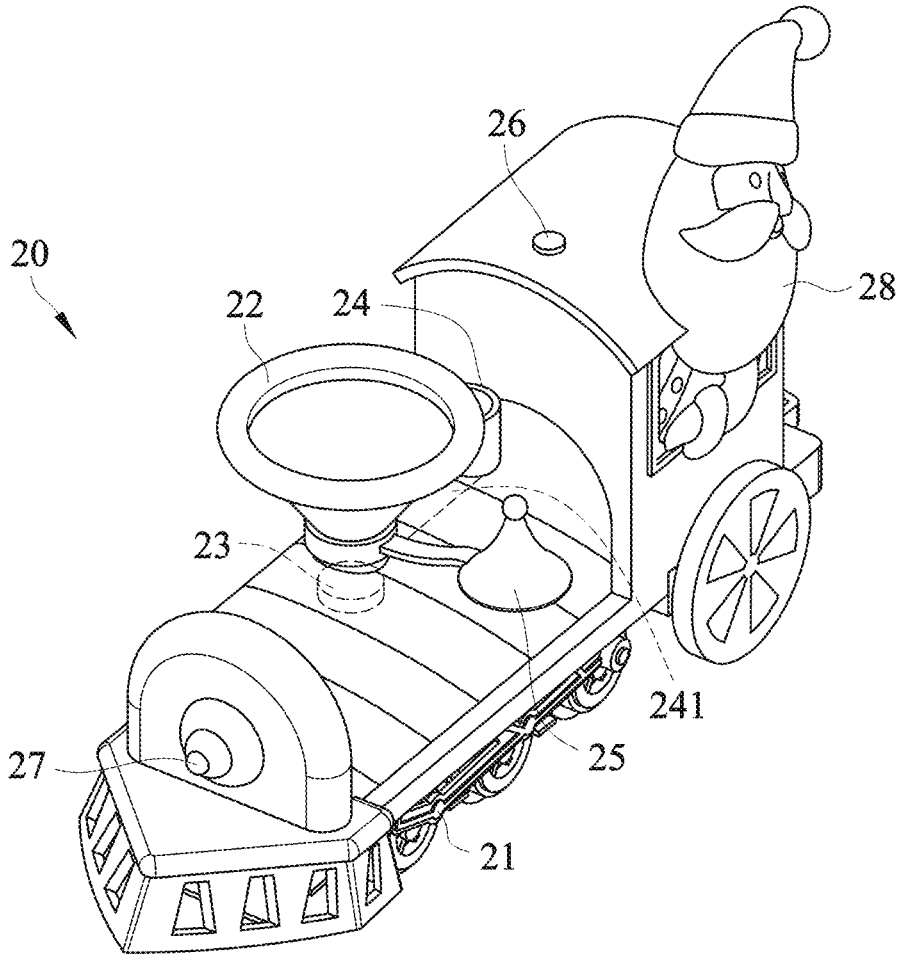
FIG. 3 is a perspective view of a locomotive of the train set structure of the disclosure.
Figure 4:
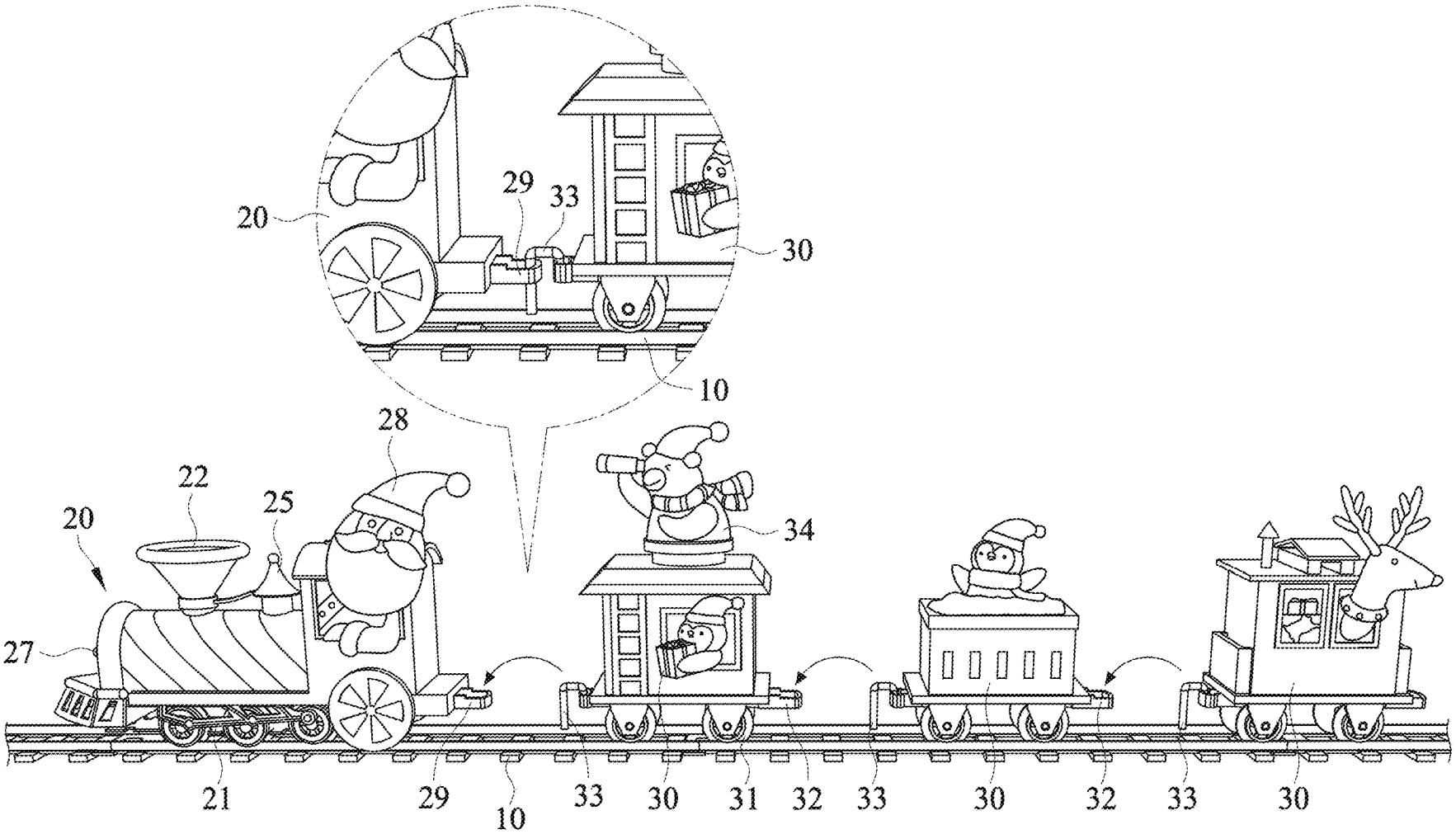
FIG. 4 is a perspective view of the locomotive and cars of the train set structure of the disclosure, showing how to connect the locomotive and the cars.
Figure 5:
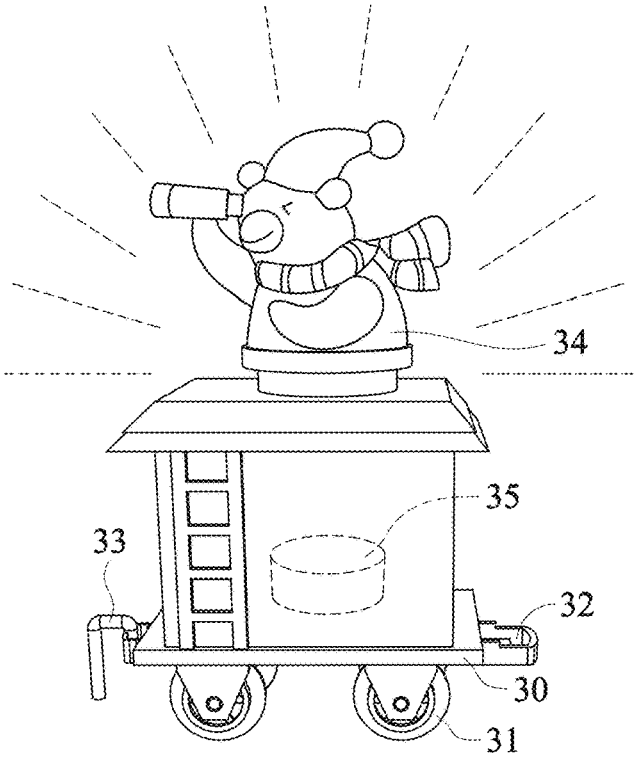
FIG. 5 is another perspective view of one of the cars of the train set structure of the disclosure.
Figure 6:
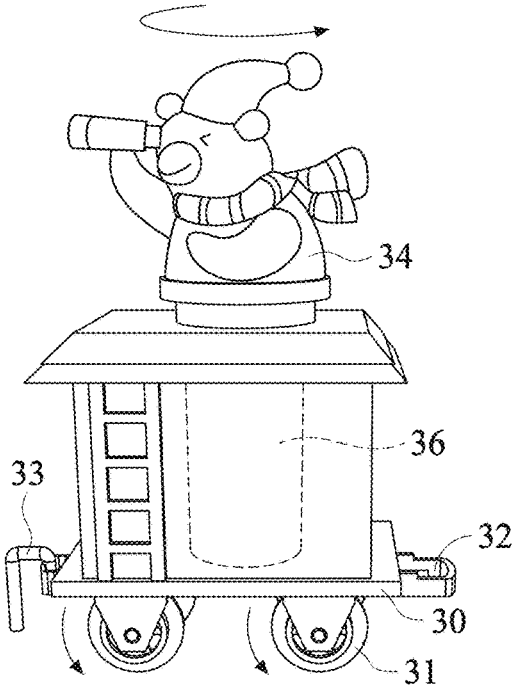
FIG. 6 is yet another perspective view of the car in FIG. 5.

Refer to FIG. 1 through FIG. 6. FIG. 1 is a perspective view of a train set structure of the disclosure. FIG. 2 is a schematic view of track segments of the train set structure according to the disclosure, showing how to connect and separate the track segments. FIG. 3 is a perspective view of a locomotive of the train set structure of the disclosure. FIG. 4 is a perspective view of the locomotive and cars of the train set structure of the disclosure, showing how to connect the locomotive and the cars. FIG. 5 is another perspective view of one of the cars of the train set structure of the disclosure. FIG. 6 is yet another perspective view of the car in FIG. 5.

Referring to FIG. 1 through FIG. 4, a train set structure of the disclosure comprises a plurality of track segments 10, a locomotive 20 and a plurality of cars 30.

One end of each of the track segments 10 has a through hole 11 and two engaging slots 12, and the other end of each of the track segments 10 has an engaging element 13 and two engaging bars 14. The engaging element 13 of each of the track segments 10 engages with the through hole 11 of one of the adjacent track segments 10, and the engaging bars 14 of each of the track segments 10 engage with the engaging slots 12 of one of the adjacent track segments 10, allowing the track segments 10 to be connected and separated.

The locomotive 20 comprises a driving unit 21, a sprayer 22, a liquid input hole 24, a switch 26, and a luminous body 27. The driving unit 21 has driving rollers abutting against the track segments 10 to drive the locomotive 20. The sprayer 22 contains a liquid, with a vibrator 23 disposed at the bottom of the sprayer 22, adapted to vibrate the liquid to produce aerosols, and electrically connected to a control circuit and a battery module. The battery module supplies power to the vibrator 23. The liquid input hole 24 has a liquid delivery duct 241 in communication with the sprayer 22 and thus enables the sprayer 22 to be replenished. The switch 26 is electrically connected to a music generator and adapted to start or stop music. The luminous body 27 is disposed on the front of the locomotive 20.

The locomotive 20 has a power-supplying unit, such as a battery (not shown), for supplying power.

The cars 30 each have a plurality of wheels 31. The plurality of wheels 31 are disposed on the track segments 10. A connection hole component 32 is disposed at one end of each of the cars 30, and a connection hook 33 is disposed at the other end of each of the cars 30. The connection hook 33 of each of the cars 30 is removably engaged with the connection hole component 32 of one of the adjacent cars 30, allowing the cars 30 to be connected and separated. The connection hook 33 of one of the cars 30 is engaged with a hole element 29 disposed at the rear end of the locomotive 20.

In an embodiment, the track segments 10 are selectively made of a resilient material, such as plastic, to have resilient deformation allowance to not only allow the engaging element 13 to be engaged with and coupled to the through hole 11 but also allow the engaging bars 14 to be engaged with and coupled to the engaging slots 12.

In an embodiment, the sprayer 22 opens upward and wide, allowing the aerosols produced to be emitted upward.

In an embodiment, the locomotive 20 comprises a decorative component 28, and each car 30 comprises a decorative component 34.

In this embodiment, depending on festivals, such as Christmas, the themes of the decorative components 28, 34 can be changed, for example, to Christmas themes, including Santa Claus, cute bear, penguin, and moose, to achieve a decorative effect.

In an embodiment, the sprayer 22 is connected to a cover 25, and the cover 25 removably conceals the liquid input hole 24.

Thus, users may open the cover 25 and add a liquid, such as water, into the liquid input hole 24. The liquid is delivered to the sprayer 22 through the liquid delivery duct 241 to replenish the sprayer 22.

In an embodiment, the connection hook 33 is pivotally repositionable.

Therefore, the connection hooks 33 swing appropriately when the cars 30 are moving on a bend of a curved path formed from the track segments 10 to allow the cars 30 to turn one by one automatically at the bend and thus move with enhance smoothness, preventing the cars 30 from flipping over.

The constituent parts and arrangement thereof of the disclosure are described above. The features and advantages of the disclosure are described below.

The production of aerosols by conventional atomization devices equipped with vibrators consumes a lot of electric power, and the electric power cannot be supplied by a battery or any other means of supplying power with low electric current; instead, the electric power is supplied in the form of external AC. As a result, the conventional atomization devices equipped with vibrators are large, bulky, and difficult to move.

By contrast, according to the disclosure, a battery module directly supplies electric power to the vibrator 23 through a control circuit, and thus the vibrator 23 need not be connected to any external power source, such as an AC power supply. Therefore, the vibrator 23 of the disclosure can be driven in any environment that lacks outlets and is small, compact, and easy to move.

The locomotive 20 generates a driving force under which the locomotive 20 and the cars 30 connected in series move on the track segments 10 automatically, accompanied by aerosols emitted from the sprayer 24 to simulate smoke leaving a chimney of a train, musical sounds, and forwarding flashes, enhancing the liveliness and entertainment of the train set.

The track segments 10, as well as the cars 30, can be connected and separated to facilitate storage, packaging and transport.

The train set structure of the disclosure further has a decorative effect.

As shown in FIG. 5, in an embodiment, the cars 30 are made of a transparent material and each have a light-emitting unit 35, whereas the connection hole components 32, the connection hooks 33, and the hole elements 29 are made of a metallic, electrically-conductive material and thus can be electrically in contact with each other. The connection hook 33 is electrically connected to the light-emitting unit 35. The hole element 29 is electrically connected to a power supply unit of the locomotive 20.

Therefore, electric power is supplied to the light-emitting unit 35 so as for the light-emitting unit 35 to emit flashes, allowing the cars 30 to emit light, exhibit entertainment effect, and look brilliant.

As shown in FIG. 6, in an embodiment, a transmission unit 36 is disposed between the decorative component 34 and the wheels 31 and adapted to convert the rotation of the wheels 31 into the rotation of the decorative component 34.

Therefore, the cars 30 move on the track segments 10 and cause the decorative components 34 to rotate synchronously without electric power, exhibiting enhanced entertainment, having an eye-catching appearance, reducing electric power consumption, and saving energy. For convenience of explanation, the embodiments are presented exemplarily. The scope of the claims of the disclosure is defined by the appended claims rather than limited to the embodiments.

What is claimed is:

1. A train set structure, comprising:

a plurality of track segments, with a through hole and two engaging slots disposed at an end of each of the track segments, an engaging element and two engaging bars disposed at another end of each of the track segments, allowing the engaging element of each of the track segments to engage with the through hole of an adjacent track segment, the engaging bars of each of the track segments to engage with the engaging slots of an adjacent track segment, so as for the track segments to be connected and separated;

a locomotive comprising a driving unit, a sprayer, a liquid input hole, a switch and a luminous body, the driving unit having driving rollers abutting against the track segments to drive the locomotive, the sprayer containing a liquid, with a vibrator disposed at a bottom of the sprayer to vibrate the liquid to produce aerosols, and electrically connected to a control circuit and a battery module, the battery module supplying power to the vibrator, the liquid input hole having a liquid delivery duct in communication with the sprayer and thus enabling the sprayer to be replenished, the switch being electrically connected to a music generator to start or stop music, and the luminous body being disposed on a front of the locomotive; and a plurality of cars each having a plurality of wheels disposed on the track segments, with a connection hole component disposed at an end of each of the cars, a connection hook disposed at another end of each of the cars, wherein the connection hook of each of the cars is removably engaged with the connection hole component of an adjacent one of the cars to connect and separate the cars, and the connection hook of one of the cars is engaged with a hole element disposed at a rear end of the locomotive, wherein the sprayer is connected to a cover, and the cover removably conceals the liquid input hole;

wherein the connection hook is pivotally repositionable; and wherein the cars are made of a transparent material and each have therein a light-emitting unit, wherein the connection hole component, the connection hook and the hole element are made of a metallic, electrically-conductive material and thus can be electrically in contact with each other, with the connection hook electrically connected to the light-emitting unit, and the hole element electrically connected to a power supply unit of the locomotive.

2. The train set structure of claim 1, wherein the track segments are selectively made of a resilient material to have resilient deformation allowance to not only allow the engaging element to be engaged with and coupled to the through hole but also allow the engaging bars to be engaged with and coupled to the engaging slots.

3. The train set structure of claim 1, wherein the locomotive has a decorative component, and each of the cars has a decorative component.

4. The train set structure of claim 3, wherein a transmission unit is disposed between the decorative component of each of the cars and the wheels to convert rotation of the wheels into rotation of the decorative component.

* * * * *